US007780146B2

(12) United States Patent
Casebolt et al.

(10) Patent No.: US 7,780,146 B2
(45) Date of Patent: Aug. 24, 2010

(54) RETRIEVAL ASSEMBLY

(75) Inventors: Scott C. Casebolt, St. Paul Park, MN (US); Vincent G. Meillet, Inver Grove Heights, MN (US)

(73) Assignee: D B Industries, Inc., Red Wing, MN (US)

( * ) Notice: Subject to any disclaimer, the term of this patent is extended or adjusted under 35 U.S.C. 154(b) by 0 days.

(21) Appl. No.: 12/235,646

(22) Filed: Sep. 23, 2008

(65) Prior Publication Data

US 2009/0084883 A1 Apr. 2, 2009

Related U.S. Application Data

(60) Provisional application No. 60/975,860, filed on Sep. 28, 2007.

(51) Int. Cl.
*B66D 1/14* (2006.01)

(52) U.S. Cl. ..... 254/346; 254/345; 254/356; 254/375; 188/290; 182/5; 182/235

(58) Field of Classification Search ..... 254/342, 254/345, 346, 347, 356, 375, 380; 188/290; 182/5, 231, 235
See application file for complete search history.

(56) References Cited

U.S. PATENT DOCUMENTS

| | | | |
|---|---|---|---|
| 659,093 | A | 10/1900 | Ockers |
| 1,363,749 | A | 12/1920 | Peterson |
| 1,724,713 | A | 8/1929 | Johnston |
| 1,950,289 | A | 3/1934 | Benson |
| 2,502,896 | A | 4/1950 | Sherbrook et al. |
| 2,776,815 | A | 1/1957 | Sheard |
| 2,809,804 | A | 10/1957 | Sheard |
| 3,081,839 | A | 3/1963 | O'Brien |
| 3,089,599 | A | 5/1963 | Casella |
| 3,101,927 | A | 8/1963 | Gray |
| 3,204,720 | A | 9/1965 | Eitel |
| 3,760,910 | A | 9/1973 | Koshihara |
| 3,999,627 | A | 12/1976 | Naka |
| 4,421,209 | A | 12/1983 | Vermette et al. |
| 4,434,869 | A | 3/1984 | Roop et al. |
| 4,437,546 | A | 3/1984 | Marinoff |
| 4,476,956 | A | 10/1984 | Eger |
| 4,523,664 | A | 6/1985 | Soubry |

(Continued)

FOREIGN PATENT DOCUMENTS

FR 1357673 A 4/1964

(Continued)

OTHER PUBLICATIONS

"Sealed Self Retracting Lifeline—Revolutionary Sealed Design Stands-Up to Even the Harshest Environments for Ultimate Safety and Reliability!", DBI/SALA®, 2 pages (© 2007—Capital Safety).

(Continued)

*Primary Examiner*—Emmanuel M Marcelo
(74) *Attorney, Agent, or Firm*—IPLM Group, P.A.

(57) ABSTRACT

A retrieval assembly is configured and arranged for use with a retractable lifeline assembly including a cable assembly. The retrieval assembly is releasably engagable with the cable assembly to pay out or retract the cable during rescue.

20 Claims, 12 Drawing Sheets

U.S. PATENT DOCUMENTS

| | | | | |
|---|---|---|---|---|
| 4,566,674 | A * | 1/1986 | Ebey et al. | 254/345 |
| 4,577,725 | A | 3/1986 | Hunter | |
| 4,589,519 | A | 5/1986 | Hunter | |
| 4,589,523 | A | 5/1986 | Olson et al. | |
| 4,598,792 | A | 7/1986 | Lew et al. | |
| 4,598,793 | A | 7/1986 | Lew et al. | |
| 4,679,656 | A | 7/1987 | Lew et al. | |
| 4,688,657 | A | 8/1987 | Erickson | |
| 4,694,934 | A | 9/1987 | Erickson | |
| 4,702,348 | A | 10/1987 | Lew et al. | |
| 4,793,436 | A | 12/1988 | Lew et al. | |
| 4,830,340 | A | 5/1989 | Knitig | |
| 5,090,507 | A * | 2/1992 | Olson et al. | 182/234 |
| 5,186,289 | A | 2/1993 | Wolner | |
| 5,305,852 | A | 4/1994 | Klokseth | |
| 5,343,976 | A * | 9/1994 | Ostrobrod | 182/4 |
| 5,860,635 | A * | 1/1999 | Morfitt et al. | 254/377 |
| 5,927,438 | A | 7/1999 | Ostrobrod | |
| 6,182,791 | B1 | 2/2001 | Cope | |
| 6,494,292 | B2 | 12/2002 | Cope | |
| 7,258,324 | B2 | 8/2007 | Gilman | |

FOREIGN PATENT DOCUMENTS

| | | | |
|---|---|---|---|
| GB | 2057871 | A | 4/1981 |
| GB | 2306107 | A | 4/1997 |
| WO | WO 95/07733 | A | 3/1995 |
| WO | WO 95/19203 | A | 7/1995 |

OTHER PUBLICATIONS

"User Instruction Manual—Sealed Self Retracting Lifelines", DBI/SALA®, 26 pages (© 2004—D B Industries, Inc.).

"Retrieval Instructions—To Engage and Disengage the Function Wench—Retractable Type Fall Arrester—AD515, EN360-EN1496 Classe B", Protecta® International, Carros, Cedex, France, 4 pages (known of prior to filing of U.S. Appl. No. 12/235,644).

Photographs of fall arrest block device, International Safety Components Ltd., Bangor, Gwynedd, United Kingdom, 11 pages (known of prior to filing of U.S. Appl. No. 12/235,644).

Fall Arrest Block UB157, ISC (International Safety Components Ltd.), Bangor, Gwynedd, United Kingdom, 4 pages (Printed Sep. 14, 2007).

Fallstop® Safety, BORNACK, pp. 55-64 (© Bornack 2007).

Fiche technique, Tractel Group, 3 pages (© TRACTEL S.A.S. 2003).

* cited by examiner

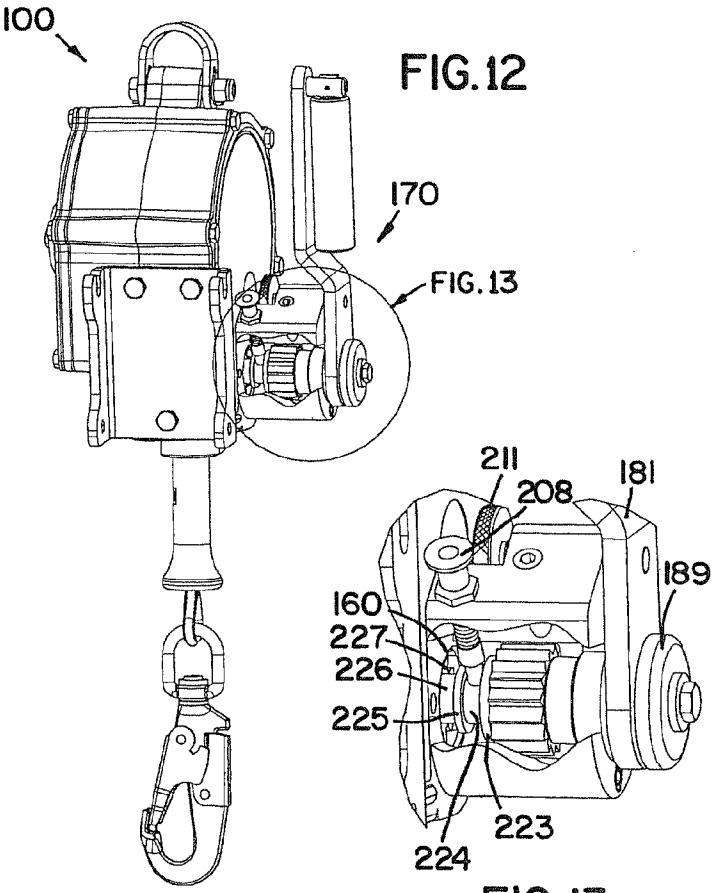
FIG.12
FIG.13
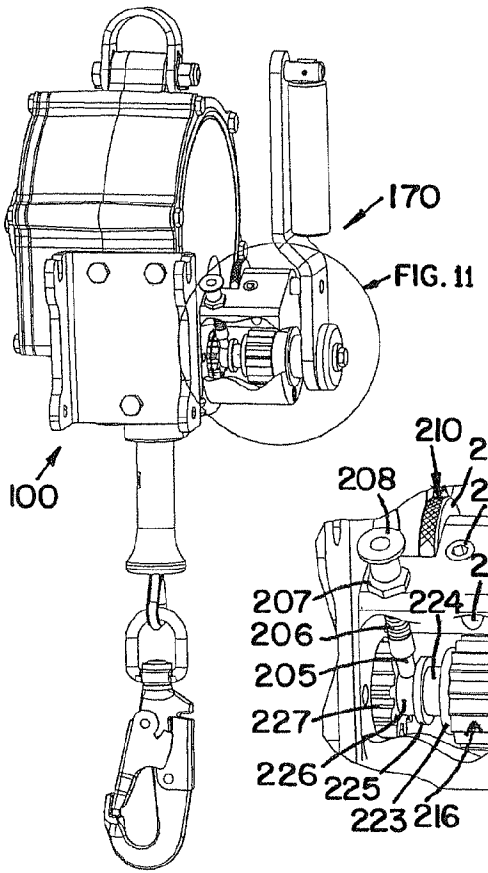
FIG.10
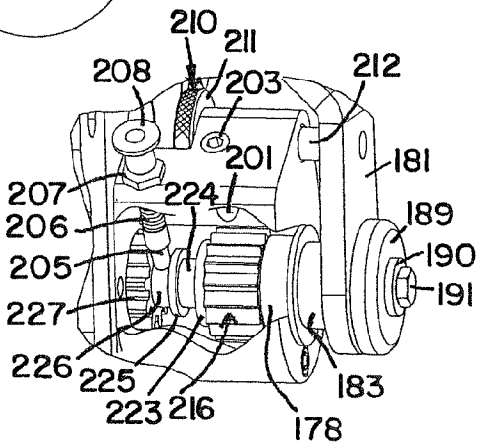
FIG.11

RETRIEVAL ASSEMBLY

This application claims the benefit of U.S. Provisional Application Ser. No. 60/975,860, filed Sep. 28, 2007.

FIELD OF THE INVENTION

The present invention relates to a retrieval assembly for use with a retractable lifeline.

BACKGROUND OF THE INVENTION

Self-retracting lifelines are commonly used by workers performing tasks during which there is a risk a fall may occur. A self-retracting lifeline generally includes a housing containing a drum around which a cable, rope, or webbing is wound. The drum is spring biased to pay out cable as tension pulling the cable is applied and to retract the cable that has been unwound from the drum as the tension on the cable is reduced or released. The housing also includes a brake assembly for stopping rotation of the drum when the cable suddenly unwinds from the drum at a rate greater than a predetermined maximum angular velocity.

A self-retracting lifeline is typically connected to a support structure within the vicinity the worker is performing the task, and the end of the cable is typically connected to a safety harness worn by the worker. The cable is easily drawn out of the self-retracting lifeline housing as the worker moves away from the device, and the cable is automatically drawn back into the housing as the worker moves toward the device. Should a fall occur, the brake assembly within the device is automatically engaged by a centrifugal clutch assembly, which gradually and quickly stops the worker's fall by gradually and quickly stopping the rotation of the drum. As the rotation of the drum is stopped, additional cable is prevented from being paid out of the housing to stop the fall of the worker.

A self-retracting lifeline could also include a retrieval assembly, which retracts or pays out the cable of the self-retracting lifeline, to raise or lower the worker to a safe location should a fall occur.

The present invention addresses the problems associated with the prior art devices and provides for a retrieval assembly for use with a retractable lifeline.

SUMMARY OF THE INVENTION

One aspect of the present invention provides a retrieval assembly for use with a retractable lifeline assembly comprising a housing, a drum, a cable, a gear plate, a base, a shaft, an arm, and a cap. The drum is received in the housing, and the cable is wound about the drum. The gear plate is coupled to the drum and has teeth. The housing has a housing aperture allowing access to the teeth of the gear plate. The base is coupled to the housing. The shaft is received in the base and has a toothed gear extending through the housing aperture. The toothed gear selectively engages the teeth of the gear plate. The arm is coupled to the shaft, and the arm is configured and arranged to rotate the shaft. The arm includes a stop. The cap is configured and arranged to retain the arm to the shaft. The cap has a first side and a second side. The first side of the cap has a detent extending partially about the first surface, and the stop of the arm is received in the detent of the first side such that the first side of the cap is proximate the arm.

Another aspect of the present invention provides a retrieval assembly for use with a retractable lifeline assembly comprising a housing, a drum, a cable, a gear plate, a base, a shaft, an arm, and an arm lock. The drum is received in the housing, and the cable is wound about the drum. The gear plate is coupled to the drum and has teeth. The housing has a housing aperture allowing access to the teeth of the gear plate. The base is coupled to the housing. The shaft is received in the base, and the shaft has a toothed gear extending through the housing aperture. The toothed gear selectively engages the teeth of the gear plate. The arm is coupled to the shaft, and the arm is configured and arranged to rotate the shaft. The base includes a first side, a second side, and a base lock bore. The arm further has an arm lock aperture that is aligned with the base lock bore when the arm is in a select position. The first side of the base is proximate the housing and the second side of the base is proximate the arm. The arm lock has an arm lock shaft positioned between a flange portion and a receiving end. The arm lock shaft of the arm lock is received in the base lock bore of the base such that the flange portion is proximate the first side of the base. The arm lock is configured and arranged to lock the arm in place by rotating the flange to manipulate the arm lock shaft portion of the arm to extend outward proximate the second side of the base so that the receiving end of the arm lock is received in the arm lock aperture of the arm.

Another aspect of the present invention provides a retrieval assembly for use with a retractable lifeline assembly comprising a housing, a drum, a cable, a gear plate, a base, a shaft, an arm, and a bearing. The drum is received in the housing, and the cable is wound about the drum. The gear plate is coupled to the drum and has teeth. The housing has a housing aperture allowing access to the teeth of the gear plate. The base is coupled to the housing. The shaft is received in the base, and the shaft has a toothed gear extending through the housing aperture. The toothed gear selectively engages the teeth of the gear plate. The arm is coupled to the shaft and is configured and arranged to rotate the shaft. The arm includes a cylindrical portion that is received in a main bore of the base. A bearing is positioned between the cylindrical portion of the arm and a surface that defines an opening to the main bore.

BRIEF DESCRIPTION OF THE DRAWINGS

FIG. 10 is a side view of the retractable lifeline and retrieval assembly shown in FIG. 1 with a portion of a base of a retrieval assembly cut away showing the retrieval assembly in a disengaged position;

FIG. 11 is a side view of detail A of FIG. 10;

FIG. 12 is a side view of the retractable lifeline and retrieval assembly shown in FIG. 1 with a portion of a base of a retrieval assembly cut away showing the retrieval assembly in an engaged position;

FIG. 13 is a side view of detail B of FIG. 12;

DETAILED DESCRIPTION OF A PREFERRED EMBODIMENT

Figure 1:
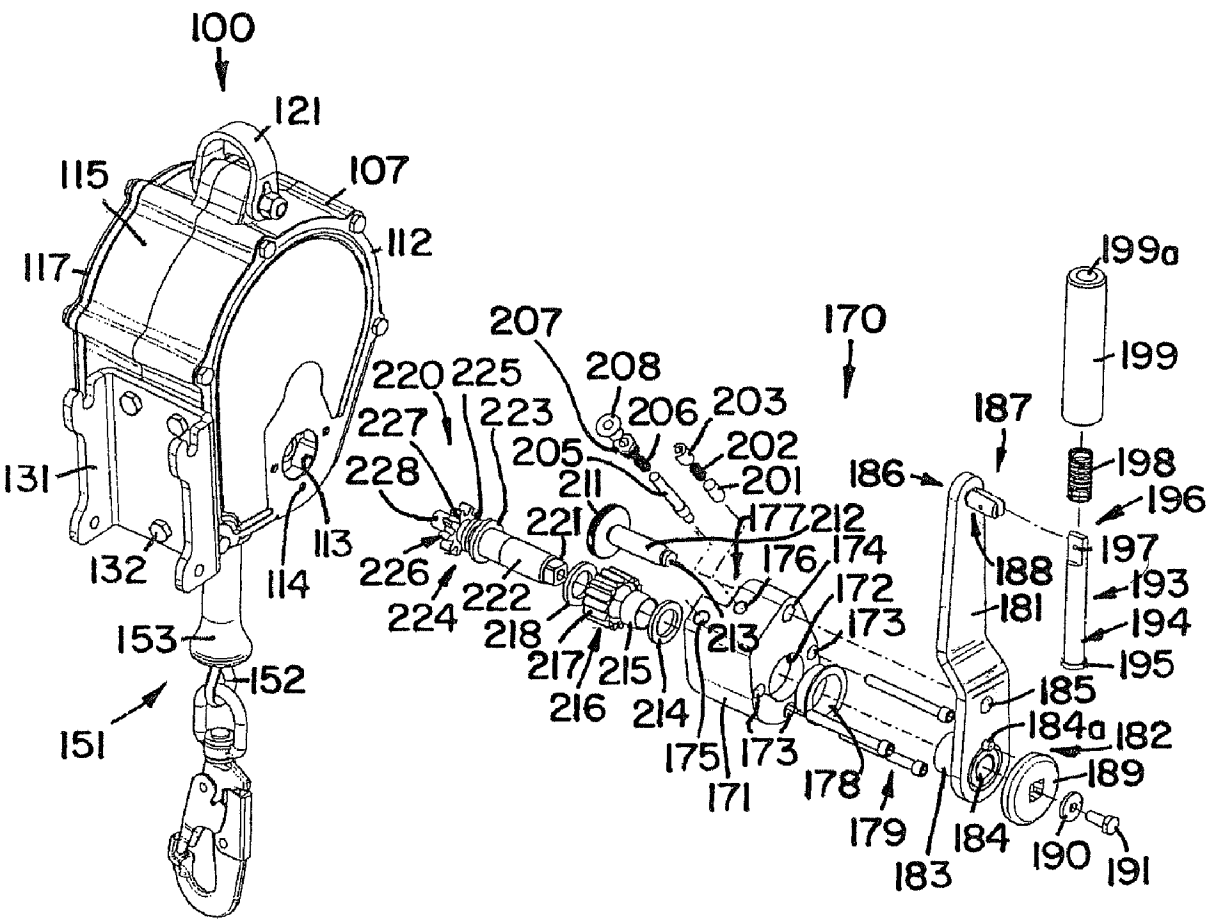
FIG. 1 is a perspective view of a retractable lifeline and retrieval assembly and an exploded perspective view of a retrieval assembly of the retractable lifeline and retrieval assembly constructed according to the principles of the present invention.

A preferred embodiment retractable lifeline and retrieval assembly constructed according to the principles of the present invention is designated by the numeral 100 in the drawings.

The retractable lifeline and retrieval assembly 100 includes a housing 101 having a top 118, a bottom 125, a first side 126, and a second side 129. The housing 101 is separated into a first portion 107 and a second portion 115 by a plate portion 103. Preferably, the first portion 107, the second portion 115, and the plate portion 103 are integral. The plate portion 103 includes an aperture 104, which is preferably a bore and is in fluid communication with a first cavity 108 of the first portion 107 and a second cavity 116 of the second portion 115. A flange 105 extends outward about the aperture 104 from the plate portion 103 into the first cavity 108. A notch 109 proximate the bottom of the first portion 107 provides a cable exit. The first portion 107 includes a protrusion 134 extending inward into the first cavity 108 proximate the bottom and the first side of the first portion 107, and the protrusion 134 includes a first bore 110 in which a bearing 135 is positioned. Above the notch 109 is a cylindrical protrusion with a second bore 111 about which a roller 136 is positioned and secured thereto with a fastener 137. The roller 136 reduces wear on the cable as it is paid out from and retracted into the housing 101.

A first housing plate 112 is secured to the first portion 107 with fasteners 164 and includes an aperture 113 in alignment with the first bore 110. Preferably three smaller apertures 114 are positioned around the aperture 113. A second housing plate 117 is secured to the second portion 115. A flange 119 extends upward from the top 118 of the housing 101, from both the first portion 107 and the second portion 115, and includes an aperture 120 through which a connector 121 is secured. The connector 121 is a U-shaped bracket with an aperture 122*a* on one end and an aperture 122*b* on the other end. The apertures 122*a* and 122*b* align with the aperture 120, with the flange 119 sandwiched between the ends of the connector 121. A lock washer 123 is positioned proximate each aperture 122*a* and 122*b*, and a bolt 124 is inserted through the apertures and the washers and secured thereto with a lock nut 124*b*. Each of the lock washers 123 preferably includes an inwardly projecting tab and an outwardly projecting tab. The inwardly projecting tabs are configured and arranged to fit within apertures in the connector 121 positioned above the apertures 122*a* and 122*b*, and the outwardly projecting tabs are configured and arranged to correspond with the hexagonal sides of the bolt 124 and the lock nut 124*b* and prevent them from rotating. The connector 121 is used to secure the housing 101 to an anchorage structure.

The first side 126 of the housing 101 includes a handle 127 with an aperture 128 proximate the bottom 125. The handle 127 allows the worker to hold the housing 101 with the handle 127 while connecting the connector 121 to the anchorage structure. Further, the housing 101 may be easily carried by the handle 127. The second side 129 includes a relatively flat mounting surface 130 to which an optional mounting bracket 131 may be secured with fasteners 132. The mounting bracket 131 could be configured and arranged to mount the housing 101 to a tripod or other suitable anchorage structure. In addition, the handle 127 could be used as a secondary anchorage member, as a back-up in case the primary anchorage member (for example connector 121 or bracket 131) fails, by threading a wire or other suitable device through the aperture 128 and connecting the housing 101 to an anchorage structure.

Figure 2:
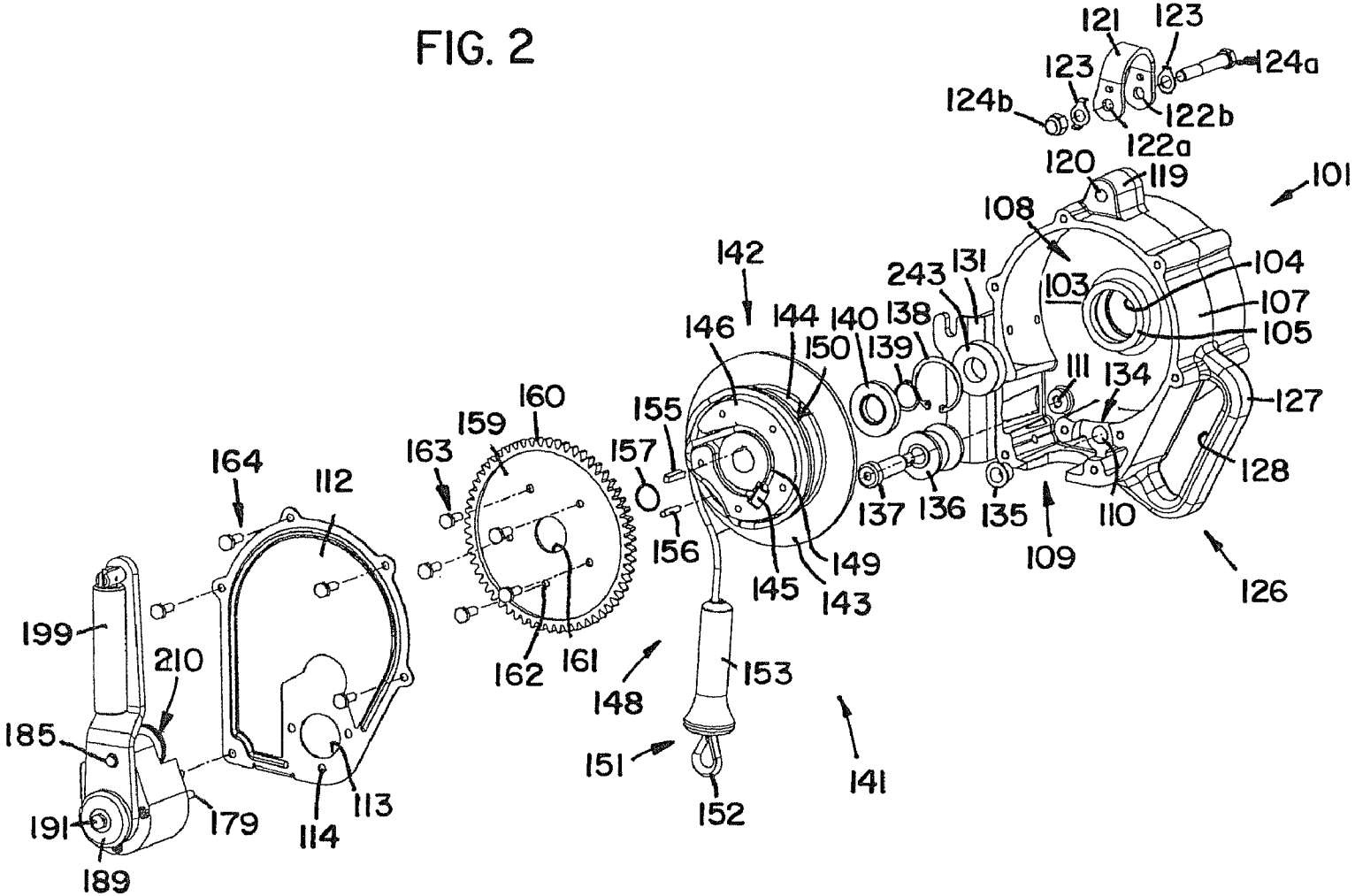
FIG. 2 is an exploded perspective view of a first housing portion assembly of the retractable lifeline and retrieval assembly shown in FIG. 1.
Figure 3:
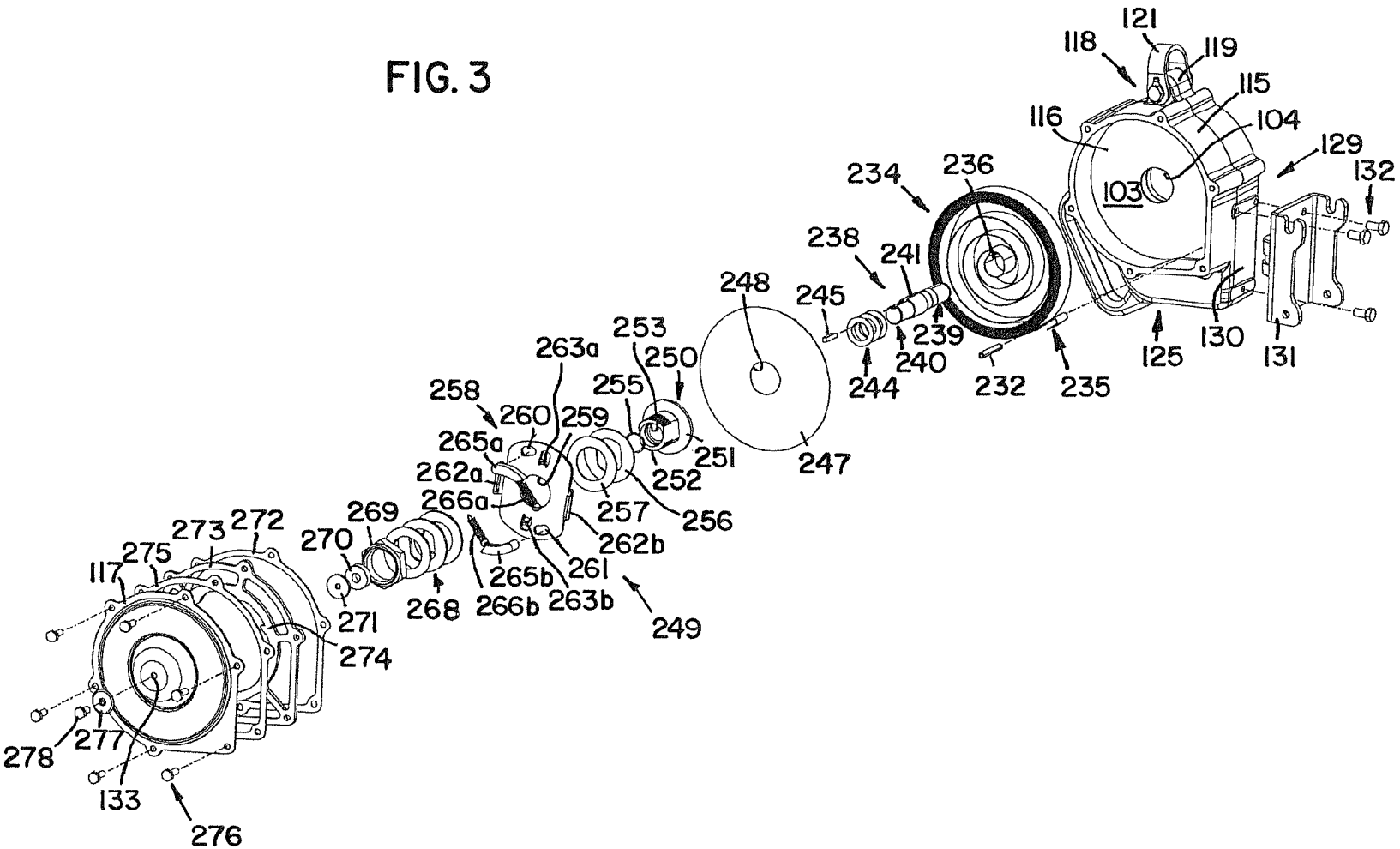
FIG. 3 is an exploded perspective view of a second housing portion assembly of the retractable lifeline and retrieval assembly shown in FIG. 1.
Figure 4:
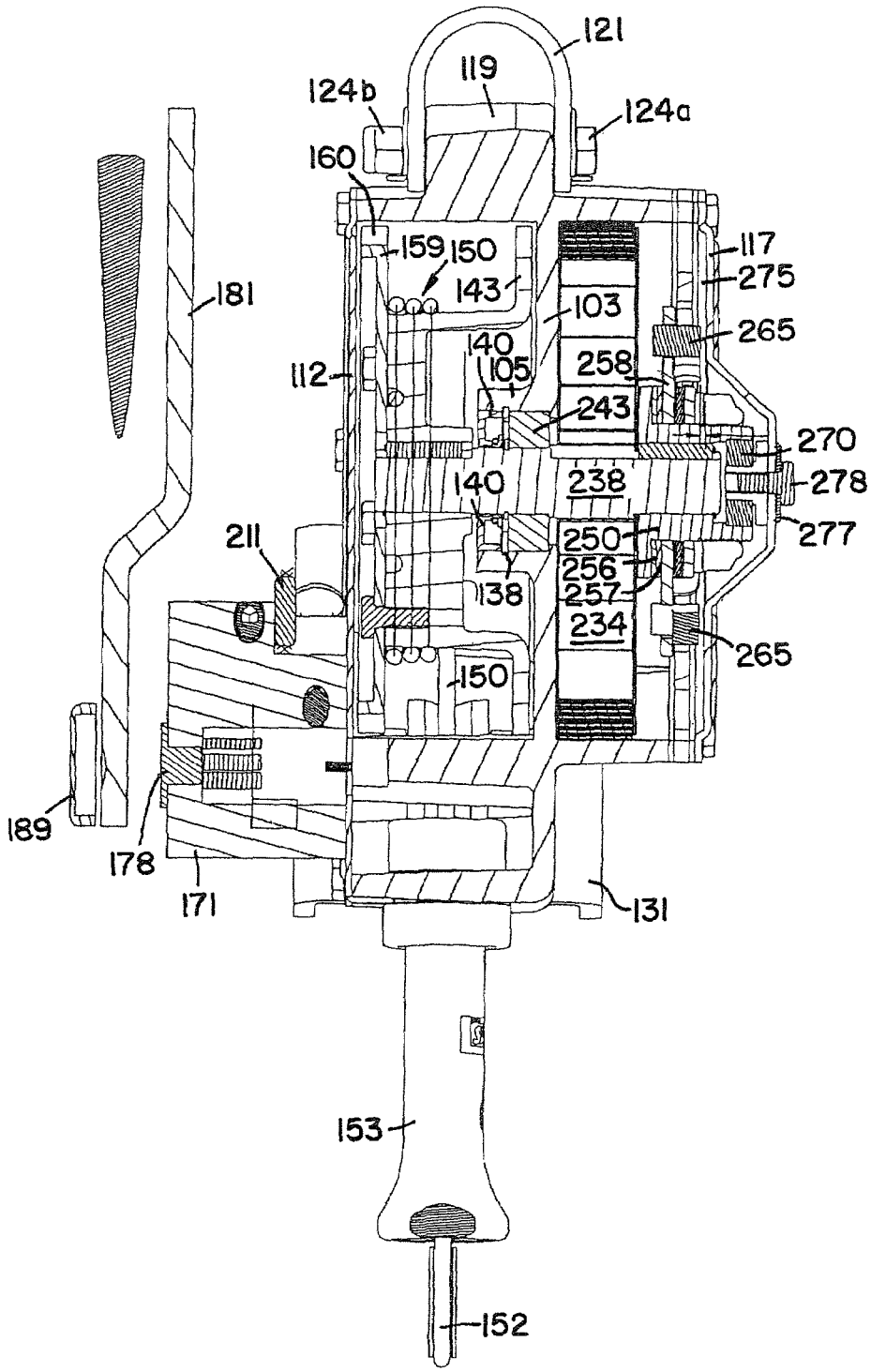
FIG. 4 is a cross section view of the retractable lifeline and retrieval assembly shown in FIG. 1.
Figure 6:
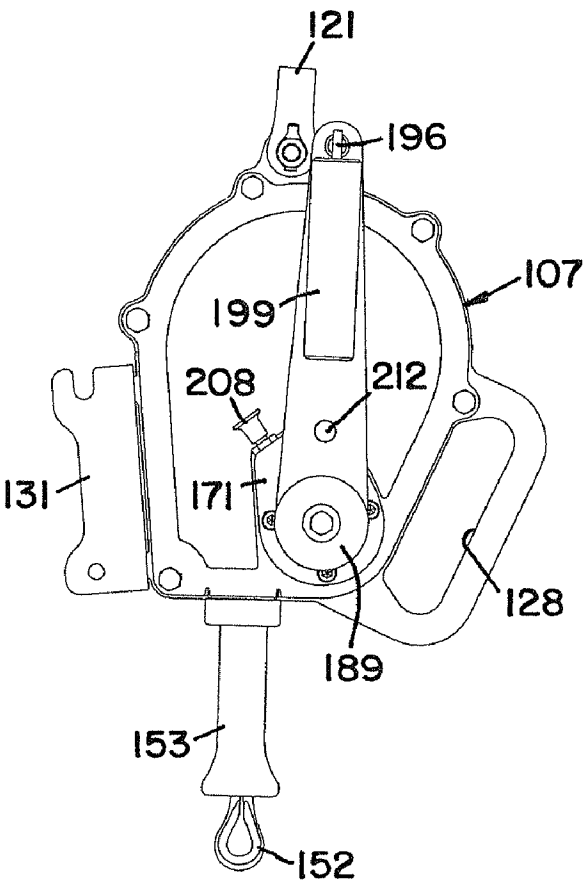
FIG. 6 is a side view of the retractable lifeline and retrieval assembly shown in FIG. 5 rotated to the left ninety degrees.
Figure 5:
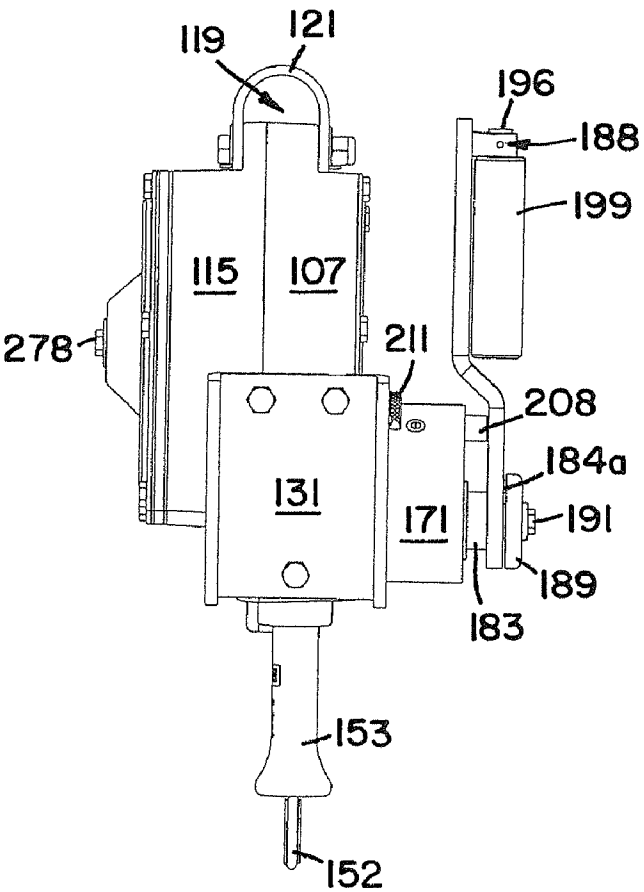
FIG. 5 is a side view of the retractable lifeline and retrieval assembly shown in FIG. 1.
Figure 17:
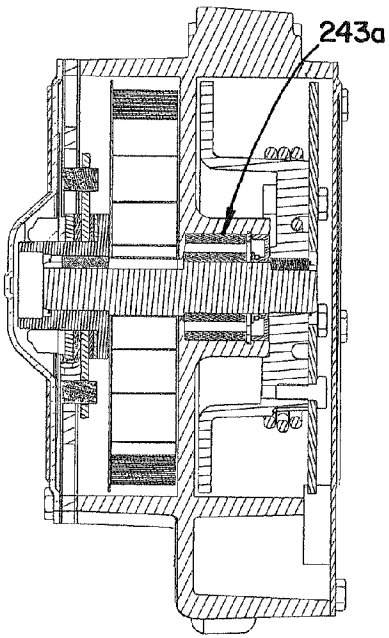
FIG. 17 is a cross section view taken along the lines 17-17 of the retractable lifeline and retrieval assembly shown in FIG. 16.
Figure 16:
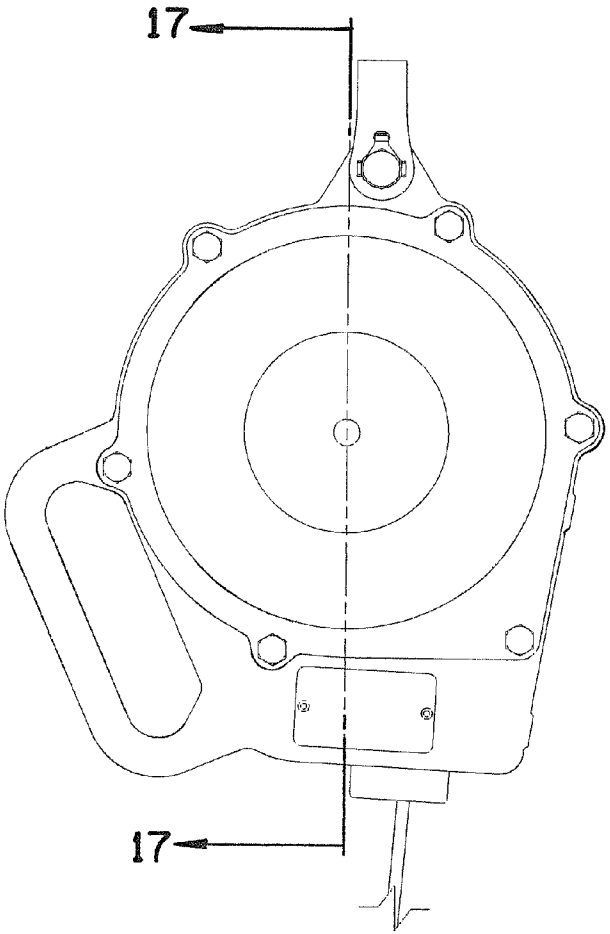
FIG. 16 is a side view of another embodiment retractable lifeline and retrieval assembly constructed according to the principles of the present invention.
Figure 19:
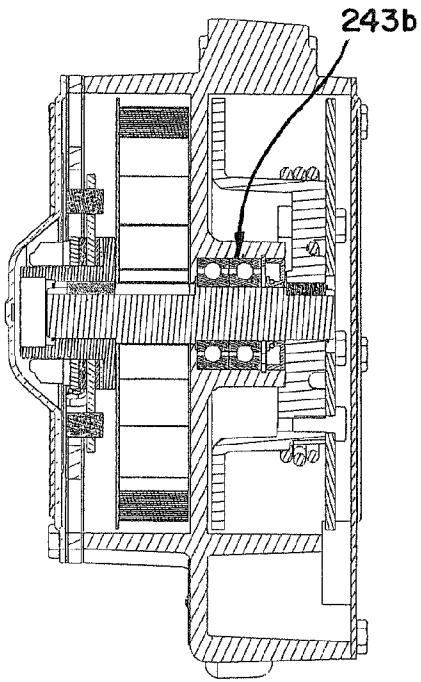
FIG. 19 is a cross section view taken along the lines 19-19 of the retractable lifeline and retrieval assembly shown in FIG. 18.
Figure 18:
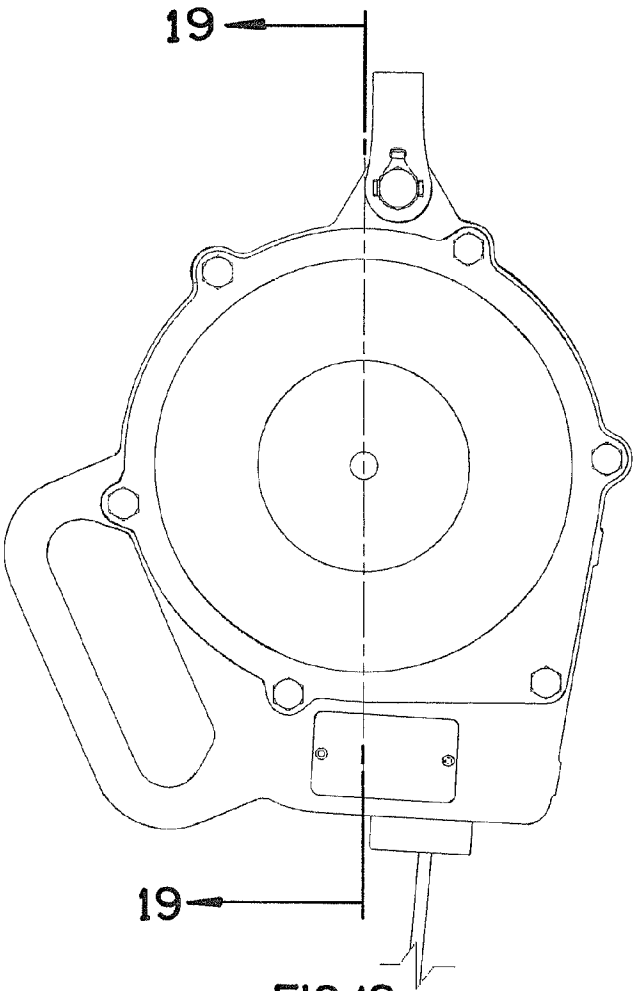
FIG. 18 is a side view of another embodiment retractable lifeline and retrieval assembly constructed according to the principles of the present invention.

The cavities 108 and 116 are configured and arranged to receive other components of the assembly 100. Generally, the first portion 107 contains the cable assembly 141 between the plate portion 103 and the first housing plate 112, as shown in FIG. 2, and the second portion 115 contains the brake assembly 249 between the plate portion 103 and the second housing plate 117, as shown in FIG. 3. A shaft 238 extends through the aperture 104 of the plate portion 103. A bearing 243 is positioned within the aperture 104 and about the shaft 238 to align the shaft 238 with the aperture 104. Any suitable bearing means may be used. Additional examples of suitable bearings are the needle bearing 243*a* shown in FIG. 17 and the ball bearings 243*b* shown in FIG. 19. As shown in FIG. 4, the shaft 238 is preferably cantilevered. The shaft 238 extends from proximate the second housing plate 117 to proximate the first housing plate 112, and the bearing 243 assists in aligning the shaft 238 with the aperture 104. An external ring 138 retains the outer perimeter of the bearing 243 in the flange 105, and an internal ring 139 retains the inner perimeter of the bearing 243 to the shaft 138. An oil seal 140 is preferably inserted between the shaft 238 and the aperture 104 of the plate portion 103 proximate the first portion 107. This is shown in FIG. 2. Although the seal is shown between the shaft 238 and the aperture 104, the seal could be positioned proximate the shaft 238 and the aperture 104 by means well known in the art to seal the first cavity 108 from the second cavity 116 proximate the aperture 104.

A drum 142 includes a cylindrical portion 144 with a bore through which the shaft 238 extends, and a flange 143 extends outward from a first side of the cylindrical portion 144. The second side of the cylindrical portion 144 includes a cable connector 145, to which a connector end 149 of a cable 148 is connected, and an intermediate portion 150 of the cable 148 is routed through a cable path 146 in the second side. The rest of the intermediate portion 150 is wound about the cylindrical portion 144, and the end 151 of the cable 148 is secured into a loop 152. A stop 153 protects the end 151 and a portion of the stop 153 fits within the notch 109 to prevent the end 151 from being retracted into the housing 101. A key 155 fits within a notch in the bore of the drum 142 and secures the drum 142 to a first end 239 of the shaft 238. A shear pin 156 extends outward proximate the end of the cable path 146 to prevent a predetermined length of the cable 148, preferably approximately two feet, from unwinding off the drum 142 unless the shear pin 156 is broken due to the arrest of a fall when the cable 148 is fully unwound off the cylindrical portion 144 of the drum 142.

A gear plate 159 is secured to the second side of the drum 142 with fasteners 163 through apertures 162, and an aperture 161 aligns with the bore of the drum 142. An external ring 157 retains the drum 142 on the shaft 238 proximate the aperture 161. The gear plate 159 includes teeth 160 around its perimeter.

A retrieval assembly 170 is operatively connected to the components in the first portion 107. The retrieval assembly 170 is shown in FIG. 1. A base 171 includes a main bore 172 extending longitudinally through the base 171 from a first side to a second side. The main bore 172 aligns with the aperture 113 in the first housing plate 112, and bores 173 align with the apertures 114. A bore 174, which is preferably threaded, is positioned above the bore 172, and a notched portion 177 corresponds with the bore 174 on the side proximate the first housing plate 112. An arm lock 210 includes a flanged portion 211, preferably with a knurled surface, and a shaft 212 with a receiving end 213. The shaft 212 is preferably at least partially threaded and extends through and mates with the bore 174 and the flanged portion 211 fits within the notched portion 177. A first lateral bore 175 extends from the top of the base 171 to the bore 172, and a second lateral bore 176 extends from the top of the base 171 proximate the notched portion 177 to the bore 172.

Figure 8:
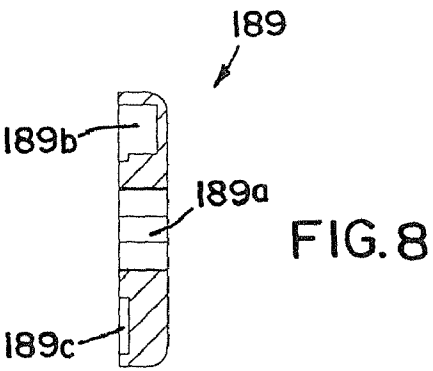
FIG. 8 is a cross section view taken along the lines 8-8 of the cap shown in FIG. 7.
Figure 9:
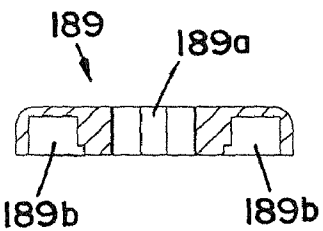
FIG. 9 is a cross section view taken along the lines 9-9 of the cap shown in FIG. 7.
Figure 7:
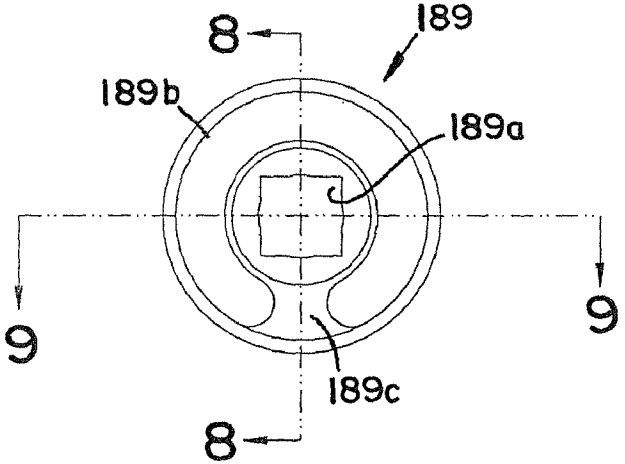
FIG. 7 is a rear view of a cap of the retrieval assembly shown in FIG. 1.

A bearing 178 fits within the bore 172 proximate the side opposite the first housing plate 112, and a cylindrical portion 183 extends outward from a first end 182 of an arm 181 and fits within the bearing 178 and rotates thereabout. The cylindrical portion 183 includes a bore 184 extending through the first end 182 of the arm 181. A stop 184*a* extends outward from the first end 182 above the bore 184. A cap 189, shown in more detail in FIGS. 7-9, includes an aperture 189*a* extending from its inner surface (first side) to its outer surface (second side). The inner surface includes a detent 189*b*, or a semi-circular groove, extending around a majority of the aperture 189*a*. A stop 189*c* interrupts the detent 189*b*. The stop 184*a* of the arm 181 fits within the detent 189*b* of the cap 189. The outer surface is preferably a smooth, solid surface to provide a more finished appearance and protect the mechanism. The cap 189 is preferably made of stainless steel. A shaft 220 extends through the bore 172, the bearing 178, and the bore 184. A washer 190 is positioned proximate the aperture 189*a* and the outer surface, and a fastener 191 secures the cap 189 to a first end 221 of the shaft 220.

The arm 181 includes an aperture 185 alignable with the bore 174. When the retrieval assembly 170 is not being used, the arm 181 may be locked by threading the threaded shaft 212 of the arm lock 210 through the bore 174 and inserting the receiving end 213 of the arm lock 210 through the aperture 185. Alternatively, the receiving end 213 could be threaded to mate with threads in the aperture 185. It is recognized that other connecting means to connect the arm lock 210 to the arm 181 could be used. A second end 186 of the arm 181 includes a forked extension 187 with a bore 188 extending outward from the side opposite the first housing plate 112. Because the flanged portion 211 of the arm lock 210 is positioned between the first housing plate 112 and the base 171, the arm lock 210 is more protected and the risk of bending or damaging the arm lock 210 is reduced.

A handle 193 includes a first end 194 with a flange 195 and a second end 196 with an aperture 197. The second end 196 preferably includes a flattened portion that fits between the two extensions of the forked extension 187, and the aperture 197 aligns with the bore 188. A fastener (not shown) secures the second end 196 to the forked extension 187. A spring 198 inside a bore 199*a* of a cylindrical member 199 extends around the handle 193 between the flange 195 and the forked extension 187. The spring 198 biases the cylindrical member 199 away from the flange 195. The end of the cylindrical member 199 proximate the forked extension 187 is configured and arranged to fit over the forked extension 187. The handle 193 may be folded inward toward the arm 181 when not in use. To fold the handle 193, the cylindrical member 199 is pushed toward the flange 195, thus compressing the spring 198, so that the forked extension 187 is no longer within the bore 199*a*. The handle 193 is then pivoted about the fastener downward toward the first end 182 of the arm 181.

The shaft 220 includes the first end 221, a shaft portion 222, and a second end 228. The shaft portion 222 is preferably threaded with a left hand thread. The cylindrical portion 183 is threaded to mate with the threaded shaft portion 222. Between the shaft portion 222 and the second end 228 are a first flange 223, a second flange 225, and a toothed gear 227. The second flange 225 is positioned between the first flange 223 and the toothed gear 227. Between the first flange 223 and the second flange 225 is a first surface 224, and between the second flange 225 and the toothed gear 227 is a second surface 226.

Before the shaft 220 is inserted into the bore 172, a friction disk 218 is positioned on the shaft portion 222 proximate the first flange 223, a ratchet 216 with teeth 217 is positioned on the shaft portion 222 proximate the friction disk 218, a bearing 215 is positioned on the shaft portion 222 proximate the ratchet 216, and a friction disk 214 is positioned on the shaft portion 222 proximate the bearing 215. The shaft 220 is supported by the bearings 178 and 215.

Within the first lateral bore 175 is a pin 205 biased by a spring 206 into the bore 172 and secured within the first lateral bore 175 with a fastener 207 and a fastener 208. The pin 205 is moved into an unlocked position by pulling out the fastener 208, which is secured to the end of the pin 205. Within the second lateral bore 176 is a pin 201 biased by a spring 202 into the bore 172 and secured within the second lateral bore 176 with a set screw 203. The pin 205 is configured and arranged to align with the first surface 224 and the second surface 226, and the pin 201 is configured and arranged to align with the ratchet 216. The pin 205 engages the first surface 224 to lock the assembly 170 into an engaged position, and the pin 205 engages the second surface 226 to lock the assembly 170 into a disengaged position. The pin 201 engages the teeth 217 to allow rotation of the shaft 220 in only one direction. With the pin 205 pulled out, the handle 181 is pushed in to engage the toothed gear 227 with the teeth 160 of the gear plate 159 and pulled out to disengage the toothed gear 227. Fasteners 179 extend through bores 173 and apertures 114 to connect the base 171 to the first housing plate 112.

Within the second cavity 116, a coil pin 232 interconnects the second portion 115 to a first end 235 of a motor spring 234. The second end 236 of the motor spring 234 is inserted into a slot 241 in the shaft 238, which as described above is connected to the drum 142 in the first cavity 108. A key 245 secures the second end 236 to the shaft 238. A ball bearing 243 is positioned on the shaft 238 proximate the aperture 104 and the motor spring 234. Washers 244 are positioned on the shaft 238 proximate its second end 240 and the other side of the motor spring 234. An isolation disk 247 protects the motor spring 234 and includes an aperture 248 through which the shaft 238 extends.

A brake hub 250 includes a flange 251 extending outward from a threaded shaft 252 through which a bore 253 extends longitudinally therethrough. The shaft 238 extends through the bore 253, and the flange 251 is proximate the isolation disk 247. A ring 255 fits within the bore 253 around the shaft 238 and retains the brake hub 250 to the shaft 238. A pressure plate 256 is positioned on the shaft 252 of the brake hub 250 proximate the flange 251, and a friction disk 257 is positioned on the shaft 252 proximate the pressure plate 256. The shaft 252 is inserted through an aperture 259 in a brake plate 258. The brake plate 258 is preferably generally oval-shaped with opposing portions and includes a first slot 260 in one portion and a second slot 261 on the opposing portion. A first flange 262*a* extends between the opposing portions on one side, and a second flange 262*b* extends between the opposing portions on the other, opposite side. A first tab 263*a* is preferably a bent tab extending outward from proximate a middle of one opposing portion of the brake plate 258 with the first slot 260 between the first tab 263*a* and the first flange 262*a*. A second tab 263*b* is preferably a bent tab extending outward from proximate a middle of the other opposing portion of the brake plate 258 with the second slot 261 between the second tab 263*b* and the second flange 262*b*. A first pawl 265*a* is slidably connected within the first slot 260, and a first spring 266*a* interconnects the first pawl 265*a* and the first tab 263*a*. A second pawl 265*b* is slidably connected within the second slot 261, and a second spring 266*b* interconnects the second pawl 265*b* and the second tab 263*b*.

Friction disks 268 are positioned on the threaded shaft 252 of the brake hub 250 proximate the brake plate 258, and a lock nut 269 is threaded onto the threaded shaft 252 to secure these components onto the brake hub 250. The lock nut 269 is preferably adjusted to set the desired torque at which the brake plate 258 slips prior to final assembly of the retractable lifeline and retrieval assembly 100. The torque could be checked 12 to 24 hours later and re-set, if necessary, prior to final assembly.

Ball bearing 270 is inserted between the bore 253 of the brake hub 250 and the stub shaft 271 to allow the brake hub 250 to be properly supported. A first gasket housing 272, a ratchet ring 273 with an inner teeth ring 274, a second gasket housing 275, and the second housing plate 117 are secured to the second portion 115 with fasteners 276. A self-sealing flat washer 277 is positioned proximate an aperture 133 in the second housing plate 117, and a fastener 278 secures the stub shaft 271 to the second housing plate 117. Thus, the second portion 115 is sealed to assist in preventing contaminants from entering the second cavity 116 and to assist in ensuring the brake assembly 249 works properly. The oil seal 140 and the first gasket housing 272 assist in sealing the second portion 115. Contaminants could include dirt, moisture, fumes, and other foreign matter that could affect the mechanical action of the brake assembly 249.

Figure 15:
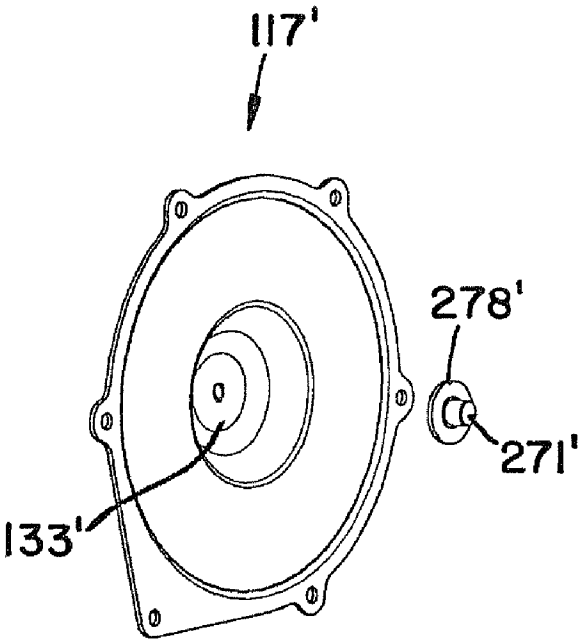
FIG. 15 is an exploded perspective view of the housing plate and a fastener shown in FIG. 14.
Figure 14:
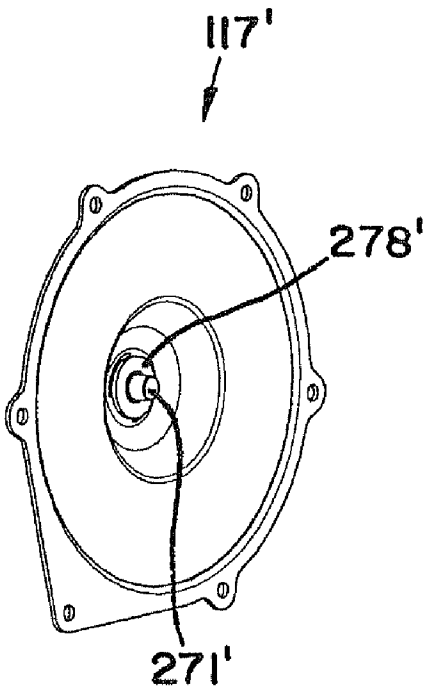
FIG. 14 is a perspective view of another embodiment housing plate for use with the retractable lifeline and retrieval assembly shown in FIG. 1.

As shown in FIGS. 14 and 15, another embodiment second housing plate 117' having a recessed portion 133' proximate the inner surface of the plate 117' could be used with a shaft 271' having a flange 278'. The shaft 271' and the flange 278' are preferably integral or operatively connected to form an integral-like component. The recessed portion 133' is configured and arranged to receive the flange 278'. The flange 278' is operatively connected to the plate 117', preferably by welding, so that the shaft 271' extends outward proximate the recessed portion 133'. This embodiment eliminates the preference to seal the aperture in the plate through which the fastener extends as with the second housing plate 117.

In operation, the drum 142 may rotate in a first direction to pay out the cable 148 and in a second direction to wind the cable 148 about the spool portion 144. The shaft 238, to which the drum 142 is connected, rotates and is biased in the second direction by the motor spring 234. The brake assembly 249 is also connected to shaft 238 and rotates with the shaft 238. Should a fall occur, the centrifugal force overcomes the force of the springs 266*a* and 266*b* causing the pawls 265*a* and 265*b* to pivot and engage the teeth 274 of the ratchet ring 273 thus preventing the shaft 238 from rotating and paying out cable. The flanges 262*a* and 262*b* assist in keeping the pawls 265*a* and 265*b*, respectively, in a position so that they are ready to engage the teeth 274 should a fall occur. If the force of the fall is sufficient to allow the brake plate 258 to slip, with the pawls 265*a* and 265*b* engaging the teeth 274, a portion of the cable 148 is paid out as the brake plate 258 and the drum 142 rotate, which provides a controlled fall arrest and absorbs energy. Preferably, up to forty-two inches of cable 148 is paid out during this controlled fall arrest and then, because the force has been reduced, the brake plate 258 stops rotating thus locking the drum 142 and preventing further cable 148 from being paid out.

When the tension is released from the cable 148, the pawls 265*a* and 265*b* are biased by the spring 266*a* and 266*b* to disengage the teeth 274, and the motor spring 234 exerts force on the shaft 238 and move the shaft in the second direction to wind the cable 148 about the drum 142, thus retracting the cable 148 into the housing 101. When the tension is initially released from the cable 148, the pawls 265*a* and 265*b* slide within the slots 260 and 261 to allow a few degrees of anti-ratcheting. When the cable 148 is initially retracted into the housing 101, at least one of the pawls remains engaged with the teeth 274 until the pawls 265*a* and 265*b* have slid to the other side of the slots 260 and 261. In other words, the slots 260 and 261 prevent the pawls 265*a* and 265*b* from disengaging the teeth 274 for a few degrees of drum rotation, which is an anti-ratcheting feature. This is disclosed in U.S. Pat. No. 4,877,110, which is incorporated by reference in its entirety herein.

If a fall has occurred, the retrieval assembly 170 may be activated to raise or lower the worker to a safe location. To activate the retrieval assembly 170, unfold the handle 193 and allow the cylindrical member 199 to cover the forked extension 187. The spring 198 biases the cylindrical member 199 to cover the forked extension 187. To unlock the arm 181, rotate the arm lock 210 so that the threaded shaft 212 no longer engages the arm 181. The cylindrical member 199 rotates about the handle 193 and the forked extension 187 and allows the arm 181 to be easily pivoted about the cylindrical portion 183. The bearing 178 assists the cylindrical portion 183 in rotating within the bore 172 in the base 171.

The retrieval assembly 170 should be in the disengaged position and then is positioned in the engaged position before it is used to raise or lower the worker. The disengaged position is when the pin 205 is positioned in the second surface 226, and the engaged position is when the pin 205 is positioned in the first surface 224. The disengaged position is shown in FIGS. 10 and 11, and the engaged position is shown in FIGS. 12 and 13. The pin 208 is pulled upward, away from the base 171, and the arm 181 is pushed inward, toward the base 171. Pulling the pin 208 pulls the pin 205 upward, allowing the pin 205 to be moved over the second flange 225 from the second surface 226 to the first surface 224, from the disengaged position to the engaged position. The arm 181 may need to be rotated to position the pin 205 in the engaged position. The pin 208 should be released, ensuring pin 205 returns to the locked position, between the toothed gear 227 and the second flange 225. In the engaged position, the shaft 220 is moved inward further into the housing 101, and the toothed gear 227 engages the teeth 160 of the gear plate 159. Thus, when in the engaged position, rotation of the shaft 220 via the handle 193 rotates the drum 142.

The cylindrical portion 183 of the arm 181 is threaded to mate with threading on the shaft portion 222. Thus, when the arm 181 is rotated in one direction (axially inward relative to the housing 101), the arm 181 moves along the length of the shaft portion 222 until it reaches the friction disk 214 and sandwiches the ratchet 216 between the friction disk 218 proximate the first flange 223 and the friction disk 214 proximate the cylindrical portion 183. After sufficient axially inward rotation of the arm 181, the frictional contact between these components is sufficiently high to cause the ratchet 216 to be rotationally fixed relative to these components. Any further rotation of the arm 181 causes rotation of the ratchet 216. The pin 201 engages the teeth 217 of the ratchet 216 and allows rotation of the ratchet 216 only in the direction of rotational tightening movement of the arm 181 on the shaft portion 222.

Thus, after the arm 181 has reached a sufficient axially inward position, further rotation of the arm 181 causes the arm 181, the ratchet 216, and the shaft 220 (including the toothed gear 227) to rotate together. When the toothed gear 227 engages the teeth 160 of the gear plate 159 in the engaged position, this rotational movement of the shaft 220 causes the cable 148 to be wound about the drum 142 thus raising the worker. The pin 201 engaging the teeth 217 of the ratchet 216 prevents counter-rotation of the drum 142.

When the arm 181 is rotated in the other direction (axially outward relative to the housing 101), the pin 201 engages the teeth 217 thus resisting rotation of the ratchet 216, which allows the arm 181 to "unthread" by moving outward along the length of the shaft portion 222. The friction between the ratchet 216 and the friction disks 214 and 218 causes resistance to rotation of the shaft 220 in this direction. As this friction is reduced by the unthreading of the arm 181, the ratchet 216 becomes easier to rotate in this direction. The ratchet 216 begins to rotate when the amount of torque necessary to rotate the shaft 220 in this direction is less than the amount of torque applied to the shaft 220 by the load on the cable 148 through the drum 142 and toothed gear 227. However, if the rotation of the arm 181 is stopped, the shaft 220 will rotate to pay out a portion of the cable 148 from the drum 142, which increases the friction as the ratchet 216 becomes more tightly sandwiched between the friction disk 218 proximate the first flange 223 and the friction disk 214 proximate the cylindrical portion 183. The increased friction as the shaft 220 rotates to pay out the cable 148 increases the amount of torque needed to rotate the arm 181 eventually until it stops the rotation of the shaft 220. Therefore, the arm 181 may be unthreaded repeatedly in this manner to slowly lower the worker with controlled pay out of the cable 148. If the arm 181 is unthreaded to proximate the distal end of the shaft portion 222, the cap 189 prevents the arm 181 from being rotated off of the shaft portion 222. The stop 184*a* of the arm 181 rotates within the groove 189*b* of the cap 189 until it reaches the stop 189*c*. The cap 189 allows the arm 181 to rotate a distance corresponding with the detent 189*b* until the stop 184*a* is proximate the stop 189*c*.

The cap 189 allows a partial rotation of the arm 181 and prevents the arm 181 from coming off of the shaft 220. Also, after raising a worker or a load with the retrieval assembly 170, the ratchet 216 and the shaft 220 could stick together and the shaft 220 will not rotate even though the arm 181 is being unthreaded from the shaft 220. The cap 189 and the stop 184*a* will force the shaft 220 to rotate after the stop 184*a* has contacted the stop 189*c* and thereby un-stick the ratchet 216 and the shaft 220.

To disengage the retrieval assembly 170, the pin 208 is pulled outward, away from the base 171, and the arm 181 is pulled outward, away from the base 171. Pulling the pin 208 pulls the pin 205 upward, allowing the pin 205 to be moved over the second flange 225 from the first surface 224 to the second surface 226, from the engage position to the disengaged position. The pin 208 should be released, ensuring pin 205 returns to the locked position, between the second flange 225 and the first flange 223. In the disengaged position, the shaft 220 is moved outward away from the housing 101, and the toothed gear 227 disengages the teeth 160 of the gear plate 159. Thus, when in the disengaged position, rotation of the shaft 220 via the handle 193 does not rotate the drum 142 as the toothed gear 227 no longer engages the teeth 160 of the gear plate 159. The arm 181 may then be locked with the arm lock 210 by threading the threaded shaft 212 into the aperture 185. The cylindrical member 199 may be pulled away from the arm 181, compressing the spring 198, so that the forked extension 187 is not within the bore 199*a*, and the handle 193 may be pivoted downward toward the first end 182 of the arm 181.

Figure 20:
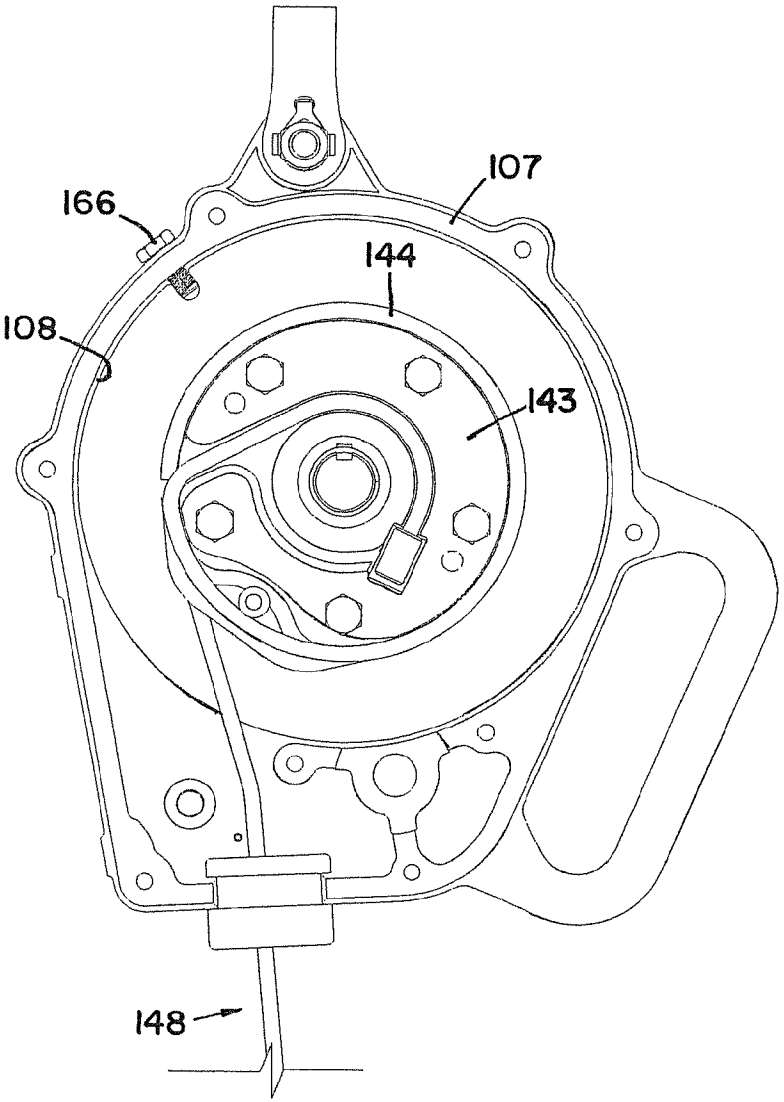
FIG. 20 is a side view of another embodiment retractable lifeline and retrieval assembly constructed according to the principles of the present invention with a retrieval assembly, a housing plate, and a gear plate removed to show a drum and a fastener.

In addition, the first portion 107 could include a bore (not shown) through which a fastener 166 extends. The fastener 166 could be a screw with threads that mate with threads in the bore. The fastener 166 could also be a pin or any other suitable fastening means. As shown in FIG. 20, when the shaft of the screw extends into the cavity 108, it is configured and arranged to engage the gear plate 159 between two teeth 160 to lock the drum 142 and prevent rotation of the drum 142. Alternatively, the fastener 166 could be pressed against a surface of the drum assembly to prevent rotation of the drum. This is preferably done when substantially all of the cable 148 is unwound from the spool portion 144. When the drum 142 is locked, the retrieval assembly 170, the first housing plate 112, and the gear plate 159 can be removed to provide access to the cable 148 including the portion routed through the cable path 146. This allows the cable 148 to be easily replaced. In addition, because the shaft 238 is preferably cantilevered, less effort is needed to replace the cable 148.

One of the advantages the retractable lifeline and retrieval assembly 100 has over prior art devices is that the oil seal 140 and the shaft 238 are concentric. In addition, the second cavity 116 is stationary, which allows the seals to function better. Unlike the prior art devices, the likelihood that the seals will loosen and require repair is reduced. Another one of the advantages is that the assembly 100 includes fewer fasteners that are less likely to break and require repair.

Figure 22:
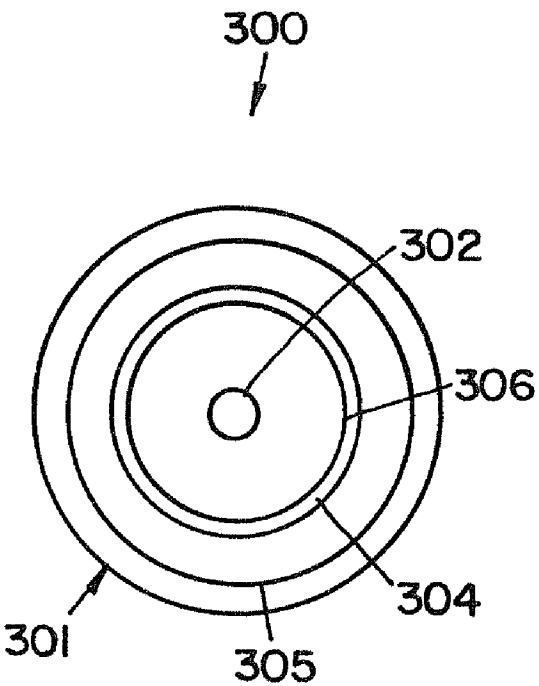
FIG. 22 is a schematic cross section view of the retractable lifeline assembly shown in FIG. 21.
Figure 21:
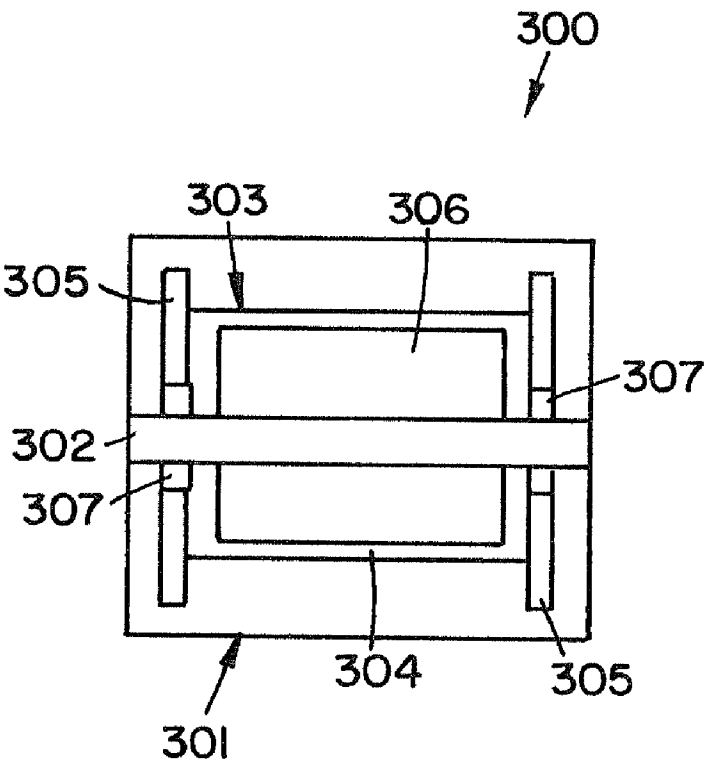
FIG. 21 is a schematic view of another embodiment retractable lifeline assembly constructed according to the principles of the present invention.

Another embodiment retractable lifeline assembly 300 is shown schematically in FIGS. 21 and 22. The assembly 300 includes a housing 301 configured and arranged to receive a shaft 302, a drum 303 including a base 304 (or spool portion) and flanges 305, and a brake assembly 306. Preferably, the shaft 302 is fixedly operatively connected to the housing 301 and the drum 303 and the brake assembly 306 are rotatably operatively connected to the shaft 302. Thus, the drum 303 and the brake assembly 306 are rotatable relative to the shaft 302 and the housing 301. Preferably, the drum 303 and the brake assembly 306 are concentric with the shaft 302, the shaft 302 being in the center and the brake assembly 306 being between the shaft 302 and the base 304 of the drum 303. A cable (not shown) is operatively connected to the drum 303 in any suitable manner well known in the art. The brake assembly 306 preferably includes a brake mechanism and a centrifugal clutch mechanism. A biasing member such as a spring interconnects the drum 303 and the shaft 302 to urge the drum 303 to rotate in a direction that winds the cable about the base 304 of the drum 303. The biasing member could be positioned either inside or outside of the base's cavity. The base 304 preferably includes a seal 307 proximate between each end and the shaft 302 to prevent contaminants from interfering with the operation of the components therein. Alternatively, the brake assembly 306 and optionally the biasing member could be contained in an inner housing that is sealed proximate the shaft 302 within the base's cavity.

Preferably, the inner portion of the drum, the shaft, and the seals define a sealed chamber within an interior portion of the base. The brake mechanism is located within the sealed chamber. A ratchet ring could be sandwiched between brake discs and operatively connected to the shaft, and at least one pawl could be mounted on the drum and engage the ratchet ring when the angular speed of the drum is sufficient.

The above specification, examples and data provide a complete description of the manufacture and use of the composition of the invention. Since many embodiments of the invention can be made without departing from the spirit and scope of the invention, the invention resides in the claims hereinafter appended.

What is claimed is:

1. A retrieval assembly for use with a retractable lifeline assembly, comprising:

a housing;

a drum received in the housing;

a cable wound about the drum;

a gear plate coupled to the drum, the gear plate having teeth, the housing having a housing aperture allowing access to the teeth of the gear plate;

a base coupled to the housing;

a shaft received in the base, the shaft having a toothed gear extending through the housing aperture, the toothed gear selectively engaging the teeth of the gear plate;

an arm coupled to the shaft, the arm configured and arranged to rotate the shaft, the arm including a stop; and a cap configured and arranged to retain the arm to the shaft, the cap having a first side and a second side, the first side of the cap having a detent extending partially about the first surface, the stop of the arm received in the detent of the first side such that the first side of the cap is proximate the arm.

2. The retrieval assembly of claim 1, wherein the detent is a semi-circular groove.

3. The retrieval assembly of claim 1, further comprising:

a fastener configured and arranged to secure the cap to the shaft.

4. The retrieval assembly of claim 1, wherein the base includes a first side and a second side, the first side having a notch portion, the base further having a threaded base lock bore, the threaded base lock bore having an opening to the notch portion, the arm further having an arm lock aperture that is aligned with the threaded base lock bore when the arm is in a select position, the first side of the base being proximate the housing and the second side of the base being proximate the arm.

5. The retrieval assembly of claim 4, further comprising:

an arm lock, the arm lock including a threaded portion positioned between a flange portion and a receiving end, the threaded portion of the arm lock threadably engaging the threaded base lock bore of the base in such a manner that the flange portion of the arm lock is received in the notch, the flange portion further configured and arranged to allow rotational manipulation of the ami lock, wherein the flange portion can be rotationally manipulated so that the receiving end of the arm lock is received in the arm lock aperture of the arm therein locking the arm in place.

6. The retrieval assembly of claim 1, further comprising:

at least one bearing between the shaft and the base to align the shaft.

7. The retrieval assembly of claim 1, wherein the arm further includes a cylindrical portion that is received in a main bore of the base, a bearing positioned between the cylindrical portion of the arm and a surface that defines an opening to the main bore.

8. A retrieval assembly for use with a retractable life line, comprising:

a housing;

a drum received in the housing;

a cable wound about the drum;

a gear plate coupled to the drum, the gear plate having teeth, the housing having a housing aperture allowing access to the teeth of the gear plate;

a base coupled to the housing;

a shaft received in the base, the shaft having a toothed gear extending through the housing aperture, the toothed gear selectively engaging the teeth of the gear plate;

an arm coupled to the shaft, the arm configured and arranged to rotate the shaft;

wherein the base includes a first side and second side, the base further having a base lock bore, the arm further having an arm lock aperture that is aligned with the base lock bore when the arm is in a select position, the first side of the base being proximate the housing and the second side of the base being proximate the arm; and an arm lock, the arm lock having an arm lock shaft positioned between a flange portion and a receiving end, the arm lock shaft of the arm lock received in the base lock bore of the base such that the flange portion is proximate the first side of the base, the arm lock configured and arranged to lock the arm in place by rotating the flange to manipulate the arm lock shaft portion of the arm to extend outward proximate the second side of the base so that the receiving end of the arm lock is received in the arm lock aperture of the arm.

9. The retrieval assembly of claim 8, wherein the arm lock shaft of the arm lock includes an at least partially threaded portion configured and arranged to threadably engage at least one of threads in the base lock bore and in the arm lock aperture.

10. The retrieval assembly of claim 8, wherein the first side of the base includes a notched portion, the base lock bore having an opening to the notched portion, the flange portion of the arm lock received in the notched portion of the base.

11. The retrieval assembly of claim 10, further comprising:

a stop on the arm; and a cap configured and arranged to retain the arm to the shaft, the cap having a first side and a second side, the first side of the cap having a detent extending partially about the first side, the stop of the arm received in the detent of the first side such that the first side of the cap is proximate the arm.

12. The retrieval assembly of claim 11, wherein the detent is a semi circular groove.

13. The retrieval assembly of claim 8, further comprising:

at least one bearing between the shaft and the base to align the shaft.

14. The retrieval assembly of claim 8, wherein the arm further includes a cylindrical portion that is received in a main bore of the base, a bearing positioned between the cylindrical portion of the arm and a surface that defines an opening to the main bore.

15. A retrieval assembly for use with a retractable life line, comprising:

a housing;

a drum received in the housing;

a cable wound about the drum;

a gear plate coupled to the drum, the gear plate having teeth, the housing having a housing aperture allowing access to the teeth of the gear plate;

a base coupled to the housing;

a shaft received in the base, the shaft having a toothed gear extending through the housing aperture, the toothed gear selectively engaging the teeth of the gear plate; and an arm coupled to the shaft, the arm configured and arranged to rotate the shaft, the arm including a cylindrical portion that is received in a main bore of the base, a bearing positioned between the cylindrical portion of the arm and a surface that defines an opening to the main bore.

16. The retrieval assembly of claim 15, further comprising:

the arm including a stop; and a cap having a first side and a second side, the first side of the cap having a detent extending partially about the first side, the stop of the arm received in the detent of the first side such that the first side of the cap is positioned proximate the arm.

17. The retrieval assembly of claim 16, wherein the detent is a semi-circular groove.

18. The retrieval assembly of claim 15, further comprising:

at least one bearing between the shaft and the base to align the shaft.

19. The retrieval assembly of claim 15, wherein the base includes a first side and second side, the first side having a notch portion, the base further having a threaded base lock bore, the threaded base lock bore having an opening to the notch portion, the arm further having an arm lock aperture that is aligned with the threaded base lock bore when the arm is in a select position, the first side of the base being proximate the housing and the second side of the base being proximate the arm.

20. The retrieval assembly of claim 19, further comprising:

an arm lock, the arm lock having a threaded portion positioned between a flange portion and a receiving end, the threaded portion of the arm lock threadably engaging the threaded base lock bore of the base in such a manner that the flange portion is received in the notch portion, the receiving end of the arm lock configured and arranged to be received in the arm lock aperture of the arm when the flange portion is rotatably manipulated to lock the arm in place.

* * * * *

UNITED STATES PATENT AND TRADEMARK OFFICE

CERTIFICATE OF CORRECTION

PATENT NO. : 7,780,146 B2
APPLICATION NO. : 12/235646
DATED : August 24, 2010
INVENTOR(S) : Casebolt et al.

It is certified that error appears in the above-identified patent and that said Letters Patent is hereby corrected as shown below:

Col. 4, line 57: "shaft 138" should read --shaft 238--

Col. 6, line 63: "handle 181" should read --arm 181--

Col. 9, line 2: "pin 208" should read --fastener 208--

Col. 9, line 4: "pin 208" should read --fastener 208--

Col. 9, line 9: "pin 208" should read --fastener 208--

Col. 10, line 1: "groove 189b" should read --detent 189b--

Col. 10, line 14: "pin 208" should read --fastener 208--

Col. 10, line 16: "pin 208" should read --fastener 208--

Col. 10, line 20: "pin 208" should read --fastener 208--

Col. 11, line 52, claim 1: "first surface" should read --first side of the cap--

Col. 11, line 53, claim 1: "first side such" should read --first side of the cap such--

Col. 11, line 61, claim 4: "first side having" should read --first side of the base having--

Col. 12, line 7, claim 5: "notch," should read --notch portion,--

Col. 12, line 46, claim 8: "flange" should read --flange portion--

Col. 12, line 47, claim 8: please delete "portion" after the word "shaft"

Col. 12, line 63, claim 11: "first side," should read --first side of the cap,--

Col. 12, line 64, claim 11: "first side such" should read --first side of the cap such--

Col. 14, line 1, claim 16: "side," should read --side of the cap,--

Col. 14, line 2, claim 16: "side such" should read --side of the cap such--

Col. 14, line 10, claim 19: "first side having" should read --first side of the base having--

Signed and Sealed this

Twenty-first Day of December, 2010

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,780,146 B2
APPLICATION NO. : 12/235646
DATED : August 24, 2010
INVENTOR(S) : Scott C. Casebolt et al.

It is certified that error appears in the above-identified patent and that said Letters Patent is hereby corrected as shown below:

Column 12, line 47-48, Claim 8: "...of the arm to extend" should read --of the arm lock to extend--.

Signed and Sealed this
Twenty-second Day of February, 2011

David J. Kappos

David J. Kappos
*Director of the United States Patent and Trademark Office*